US006162492A

United States Patent [19]

Narayanan

[11] Patent Number: 6,162,492

[45] Date of Patent: Dec. 19, 2000

[54] MULTI-LAYER CORRECTION AND/OR MARKING MATERIAL, PROCESS FOR ITS PRODUCTION AND ITS USE

[75] Inventor: Krishnamoorthy Narayanan, Oestrich-Winkel, Germany

[73] Assignee: Citius Bürotechnik GmbH, Gersthofen, Germany

[21] Appl. No.: 09/101,961

[22] PCT Filed: Jan. 23, 1997

[86] PCT No.: PCT/DE97/00165

§ 371 Date: Jul. 21, 1998

§ 102(e) Date: Jul. 21, 1998

[87] PCT Pub. No.: WO97/27063

PCT Pub. Date: Jul. 31, 1997

[30] Foreign Application Priority Data

Jan. 26, 1996 [DE] Germany ..... 196 02 809

[51] Int. Cl.[7] ..... B05D 5/00

[52] U.S. Cl. ..... 427/140; 427/155; 427/208.8; 427/412.3; 427/412.4; 427/412.5

[58] Field of Search ..... 427/208.8, 412.5, 427/412.4, 412.3, 140, 155, 141, 208.4

[56] References Cited

U.S. PATENT DOCUMENTS

| | | | |
|---|---|---|---|
| 2,937,956 | 5/1960 | Fendius et al. | 427/208.8 |
| 3,942,621 | 3/1976 | Karlan | 197/181 |
| 4,035,218 | 7/1977 | Yount | 427/208.8 |
| 4,092,280 | 5/1978 | Barouh et al. | 427/141 |
| 4,321,286 | 3/1982 | Scott et al. | 427/141 |
| 4,883,379 | 11/1989 | Fukuda et al. | 400/697.1 |
| 4,891,260 | 1/1990 | Kunkel et al. | 428/220 |
| 4,913,560 | 4/1990 | Herrington | 427/208.8 |
| 4,999,076 | 3/1991 | Incremona et al. | 427/208.8 |
| 5,120,383 | 6/1992 | Takei et al. | 156/240 |
| 5,176,939 | 1/1993 | Shepherd | 427/208.8 |
| 5,240,781 | 8/1993 | Obata et al. | 428/488.4 |
| 5,322,708 | 6/1994 | Eissle | 427/208.8 |
| 5,523,118 | 6/1996 | Williams | 427/208.8 |

FOREIGN PATENT DOCUMENTS

| | | |
|---|---|---|
| 0 479 221 | 4/1992 | European Pat. Off. . |
| 0 318 804 | 4/1994 | European Pat. Off. . |
| 0 410 248 | 12/1994 | European Pat. Off. . |
| 0 644 063 | 3/1995 | European Pat. Off. . |
| 0 736 391 | 10/1996 | European Pat. Off. . |
| 37 41 022 | 6/1989 | Germany . |
| 40 28 346 | 11/1991 | Germany . |
| 41 29 413 | 3/1993 | Germany . |
| 44 02 574 | 8/1995 | Germany . |

*Primary Examiner*—Erma Cameron
*Attorney, Agent, or Firm*—Nields & Lemack

[57] ABSTRACT

The description relates to a process for producing a multi-layer correcting and/or marking material. In said process, a film is applied to a substrate which can be released therefrom and in particular contains a dye and/or pigment. A further layer containing an adhesive is then applied over the film thus obtained. The removable film is applied in the form of an aqueous suspension containing a brittle and a film-forming binder. The process makes it possible to dispense with organic solvents. A correcting or marking agent thus produced exhibits good tear-off properties.

13 Claims, No Drawings

MULTI-LAYER CORRECTION AND/OR MARKING MATERIAL, PROCESS FOR ITS PRODUCTION AND ITS USE

This application is the national stage of International Application No. PCT/DE97/00165, filed Jan. 23, 1997.

DESCRIPTION

The invention concerns a multi-layer correction material based on a siliconized carrier foil, which can be produced without the use of organic solvents or suspension agents as well as a process for its production and its use.

The covering over of mistakes in writing or typing or possible mistakes in drawings with pigmented liquid systems and typing or painting again, if need be, after drying is known. These systems, however, have the disadvantage that they frequently contain an easily volatile organic solvent, which leads to environmental pollution upon evaporating. With the use of aqueous systems, in fact, environmental pollution is avoided, but a prolonged drying time must be bargained with.

For this reason, multi-layer transfer tapes have been developed, in which a pigmented covering layer lying on a carrier is coated with a semi-adhesive layer. In this way, the multi-layer correction material with its semi-adhesive layer is positioned over the place to be corrected or covered up and pressure is exercised on the above-lying carrier. In this way, the semi-adhesive layer is pressed onto the paper and remains adhered to it. The covering layer is then stripped from the carrier, which is usually configured as a foil, so that the layer now adheres to the desired paper place and covers the writing lying underneath. DE-B 3,741,022 describes a multi-layer, flexible transfer tape with a carrier foil, in which the stripping behavior of the covering layer is improved by the addition of cellulose derivatives, so that the covering layer bound to the plastic carrier is easily stripped upon application. In the production of this correction tape, however, organic solvent and dispersing agents such as isopropyl alcohol and toluene are used.

DE-A-4, 129,413 describes the production of a multi-layer correction material, which can be produced without application of organic solvents and without the co-use of cellulose derivatives that promote stripping. This is achieved by a special structure of the coating agent forming the covering layer and an adaptation with an overcoat coating responsible for the adhesion. An aqueous overcoat coating is applied onto the dried covering layer, and this overcoat contains a polyethylene wax dispersion, an anionic polyacrylate dispersion, and, if necessary, an emulsifier, as well as other common additives.

The invention now has the objective of offering a multi-layer correction material, particularly in the form of a rolled-up tape of the type initially described, which can be produced without the use of organic solvents, i.e., which can be prepared in aqueous solution or suspension alone. Another objective of the invention is to offer such a transfer or correction means, which does not require a stripping agent as an additive. Finally, it is another objective of the invention to dispense with an overcoat, which contains a wax dispersion.

The above-named objectives are achieved according to the invention with a correction and/or marking agent, which has a film that can be inscribed and stripped off that is arranged on a carrier, which is coated with an adhesive, [an agent, which] is characterized by the fact that the inscribable film or covering layer has a film-forming binding agent and a friable binding agent at room temperature. As a friable binding agent, those binding agents may also be used, which initially have film-forming properties, but form a friable compound together with the other additives, particularly with pigments.

It has been shown according to the invention both that good stripping properties can be achieved with such a structured covering film, and that the use of organic solvents as well as an overcoat containing wax can be omitted.

Film-forming binding agents are, for example, terpolymer dispersions based on vinyl acetate and acrylic acid esters, such as are marketed under the tradename Macrovil 21 2 G of Indulor Chemie GmbH, 49572 Ankum, Germany. Another film-forming binding agent that can be used according to the invention is, for example, [the group of] copolymers based on acrylic acid esters with the use of acrylonitrile, as they can be obtained under the designation Acronal 85D.

Binding agents that act in a friable manner are, for example, acrylic polymers, particularly those in ammonia, as they are marketed, for example, under the name Carboset 537 of B. F. Goodrich, Cleveland, Ohio, as a 35% solids dispersion in ammoniacal water. Another [group of] friable binding agents is copolymers containing carboxylic groups based on acrylic acid esters, as can be obtained commercially, for example, under the tradename Acronal V 205. Both correction agents as well as marking agents, so-called transliners, can be produced with the covering film of the invention. In the production of correction films, the film layer contains covering pigments, such as, for example, titanium dioxide and filling agent. In the case of marking agents or transliners, instead of a covering pigment, a fluorescing pigment, such as, for example, aminotriazine fomaldehyde co-condensates with organic dyes are contained therein.

For the production of the correction and marking agents according to the invention, an aqueous suspension of a friable and a film-forming binding agent together with a pigment, and if necessary, fluorosurfactants such as FC 170 C and anti-foaming agents, such as, for example, Acitan 281, is added, for example, to hydrophobic silicic acids, synthetic copolymers and nonionic emulsifiers. In special cases it has proven appropriate to also add pH stabilizers, such as, for example, 2-amino-2-methyl-1-propionate together with fillers and surfactants and if necessary, with thickening agents.

Such an aqueous suspension is then applied by means of a doctor blade onto a carrier foil that is preferably siliconized in a different way on the two sides. Suitable carrier foils are known to the person skilled in the art and comprise, for example, polyester, polyethylene terephthalate, polypropylene, polyethylene or polyvinyl chloride. The marking layer or the covering and inscribable layer containing color pigments is appropriately applied with a solids content of 30–80%, preferably 40–70%, and most preferably 50%. In the wet state, the applied quantity amounts to 15–70 $g/m^2$, preferably 20–65 g and most preferably, 25–45 $g/m^2$ with which, a layer thickness of 20–60 $\mu$m, particularly 35–45 $\mu$m is achieved in the wet state, which in the dry state is 8–30 $\mu$m, preferably 10–25 $\mu$m thick.

After the drying of the layer containing pigment, an aqueous solution or suspension of a coating containing an acrylic additive, and in fact in the form of an adhesive, if necessary a mixture containing adhesive with water in a ratio of 3:1 to 1:3, particularly from 1.5:1 to 1:1.5, is also applied by means of a doctor blade, preferably in a layer thickness of 5–25 $\mu$m, particularly 10–20 $\mu$m. It is also possible to apply the adhesive directly, i.e., undiluted.

The invention will be explained in more detail on the basis of the following examples.

EXAMPLE 1

Production of an Inscribable Covering Compound 3.75 kg of Acronal V205 as a friable binding agent in the form of a 69% aqueous dispersion, 3.75 kg of Acronal 85D as a film-forming binding agent in the form of a 55% aqueous dispersion, 0.44 kg of AMP 90 as a pH stabilizer (2-amino-2-methyl-1-propionate containing 10% water), 0.19 kg of Surfynol CT141 as a surface-active agent for improving the aqueous pigment dispersion, 0.31 kg of Collacral VL as a thickening agent in the form of a 3% solution of a vinylpyrrolidone copolymer, 0.16 kg of Forbest 150 W as an antifoaming agent, 0.005 kg of carbon black (carbon black FW2) as a toning pigment and 18.75 kg of water are mixed together under vigorous stirring. Then 31.25 kg of titanium dioxide (Kronos 2043) as a color pigment and 6.25 kg of aluminum silicate (ASP 400) (which can be obtained from Langer & Co., 2863 Ritterhude-lhlpohl, DE) are added with stirring and grinding. Finally, a fluorosurfactant (FC170C) is added. The solids content of the initial slurry is 65%. This compound is now applied by means of a doctor blade onto a polyester foil coated with silicone on both sides. The silicone coatings of the polyester foil are such that when the finished product is rolled up, the film-forming inscribable covering layer (cover-up) adheres more strongly to the foil than the uppermost adhesive coating to the back side of the foil. The application weight of the compound amounts to 40 $g/m^2$ in the wet state and 25–27 $g/m^2$ after drying, which corresponds to a layer thickness of 40 $\mu$m in the wet state and 20 $\mu$m in the dry state.

After drying, an adhesive coating of ACR 85D in water made up beforehand in a 1:1 ratio with a layer thickness of 15 $\mu$m is also applied by means of a doctor blade. After drying of the adhesive coating, the multi-layer correction or covering foil is finished and can be cut into strips of the desired width each time and rolled up. A product produced in this way showed good stripping or pulling-off properties.

EXAMPLE 2

Production of a Marking Tape (Transliner)

22.5 kg of Macrovil 212 G as a film-forming binding agent and 12.5 kg of Carboset 537 as a friable binding agent are mixed together while stirring. Then 2.5 kg of 25% ammonia and after that 4.4 kg of Luna Yellow T27 (aminotriazine formaldehyde co-condensate with organic dyes) as a fluorescing pigment and 0.06 kg of Agitan 281 are added together while stirring and stirred until a good dispersion is obtained. After this, 0.625 kg of FC170 are added as a fluorosurfactant. The solids content of the solution obtained in this way amounts to 50% and is applied wet onto a polyester carrier foil as described in Example 1 in a layer thickness of 40 $\mu$m wet, by means of a doctor blade. After drying, the layer thickness amounts to 13 to 14 $\mu$m.

An acrylic adhesive (ACR 85D) undiluted, is applied in a layer thickness of 15 $\mu$m over the dried transliner layer that has been applied. After complete drying, the multi-layer marking foil that is obtained in this way is cut into strips and rolled up.

A marking means produced in this way shows good stripping properties.

What is claimed is:

1. Process for the production of a multi-layer correction and/or marking material, comprising applying a removable film onto a carrier, said film containing a dye and/or coloring pigment; applying another layer containing an adhesive over said removable film applied onto said carrier; wherein said removable film is applied in the form of an aqueous suspension which comprises a mixture of a friable binding agent and a film-forming binding agent.

2. Process according to claim 1, further characterized in that a foil that is siliconized on both sides is used as the carrier.

3. Process according to claim 1 or 2, wherein said carrier comprises polyester.

4. Process according to claim 1 or 2, further characterized in that an aqueous terpolymer dispersion based on vinyl acetate and acrylic acid esters and/or an aqueous dispersion of a copolymer based on acrylic acid esters with the combined use of acrylonitrile is used as the film-forming agent.

5. Process according to claim 1 or 2, further characterized in that an aqueous dispersion of an acrylic polymer and/or an aqueous dispersion of a copolymer based on acrylic acid esters with the combined use of acrylonitrile is used as the friable binding agent.

6. Process according to claim 5, further characterized in that the aqueous dispersion of acrylic polymer contains ammonia.

7. Process according to claim 1 or 2, further characterized in that a covering color pigment is used as the color pigment.

8. Process according to claim 7, further characterized in that titanium dioxide and/or aluminum silicate is used as a covering pigment.

9. Process according to claim 1 or 2, further characterized that a non-covering dye is used.

10. Process according to claim 9, further characterized in that the non-covering dye is a fluorescing dye.

11. Process according to claim 10, further characterized in that the fluorescing dye is an aminotriazine-formaldehyde co-condensate with organic dyes.

12. Multi-layer correction and/or marking material that is obtained according to claim 1 or 2.

13. Use of a marking material that is obtained according to claim 1 or 2 for covering written materials or images and/or for marking, by means of adhesion of the pigment-containing film to the places to be corrected or marked, after which the tape is stripped from the carrier.

* * * * *